United States Patent [19]

Thompson

[11] 4,040,584

[45] Aug. 9, 1977

[54] MOUNTING ARRANGEMENTS FOR MINERAL DISPLACING TOOLS

[75] Inventor: Arthur David Thompson, Chorley, England

[73] Assignee: Dobson Park Industries Limited, Nottingham, England

[21] Appl. No.: 655,872

[22] Filed: Feb. 6, 1976

[30] Foreign Application Priority Data

Feb. 26, 1975 United Kingdom ..... 7948/75

[51] Int. Cl.[2] ..... E21C 11/02; F16M 13/00

[52] U.S. Cl. ..... 248/2; 173/43

[58] Field of Search ..... 248/2, 16; 173/38, 43, 173/28; 182/2

[56] References Cited

U.S. PATENT DOCUMENTS

| | | | |
|---|---|---|---|
| 3,056,465 | 10/1962 | Gerrans | 182/2 X |
| 3,493,200 | 2/1970 | Huffman | 248/16 |
| 3,565,184 | 2/1971 | Gustafsson | 173/28 |
| 3,721,304 | 3/1973 | Hanson | 173/43 X |
| 3,868,076 | 2/1975 | Beagan | 248/16 |
| 3,915,501 | 10/1975 | Cobb | 173/43 X |

*Primary Examiner*—J. Franklin Foss

*Attorney, Agent, or Firm*—Berman, Aisenberg & Platt

[57] ABSTRACT

A mounting arrangement for a mineral displacing tool comprises a carrier for the tool and pivot means pivotally securing the carrier to a support. A link member is attached at one end to the pivot means, and first and second pressure-fluid-operated rams are pivotally connected to act between the other end of said link means and the carrier and the support, respectively. Each ram serves to extend the arc of slewing of the carrier with respect to the support attainable by means of the other ram. Preferably, one of the rams is arranged to slew the carrier in a clockwise direction from a given position, and the other of the rams is arranged to slew the carrier in a counter-clockwise direction from the given position.

13 Claims, 6 Drawing Figures

MOUNTING ARRANGEMENTS FOR MINERAL DISPLACING TOOLS

The present invention relates to mounting arrangements for mineral displacing tools such as impact chisels used in mining.

It is known to mount mineral displacing tools on a carriage itself supported from an extensible boom projecting from a support base in such a manner that the tool can be slewed on its carriage and the carriage pivoted with respect to the boom, and in some cases the boom itself, in addition to being extensible and retractable, may be slewable with respect to the support base, the various motions of the various parts being effected hydraulically. It is the object of the invention to provide a mounting arrangement for a mineral displacing tool of this general type wherein control of slewing of the tool with respect to its support is effected by selective operation of two mutually co-operable pressure-fluid-operated rams whereby the total arc of slewing is shared by the two rams. By this means the total arc of slewing may be greater than 180°.

According to the invention there is provided a mounting arrangement for a mineral displacing tool comprising a carrier for the tool, pivot means pivotally securing said carrier to a support, a link member attached at one end to said pivot means, and first and second pressure-fluid-operated rams pivotally connected to act between the other end of said link means and said carrier and support, respectively, whereby each ram serves to extend the arc of slewing of the carrier with respect to the support attainable by means of the other ram.

The various features and advantages of the invention will be apparent from the following description of a mining machine embodying the invention taken in conjunction with the accompanying drawings of which:

Figure 1:
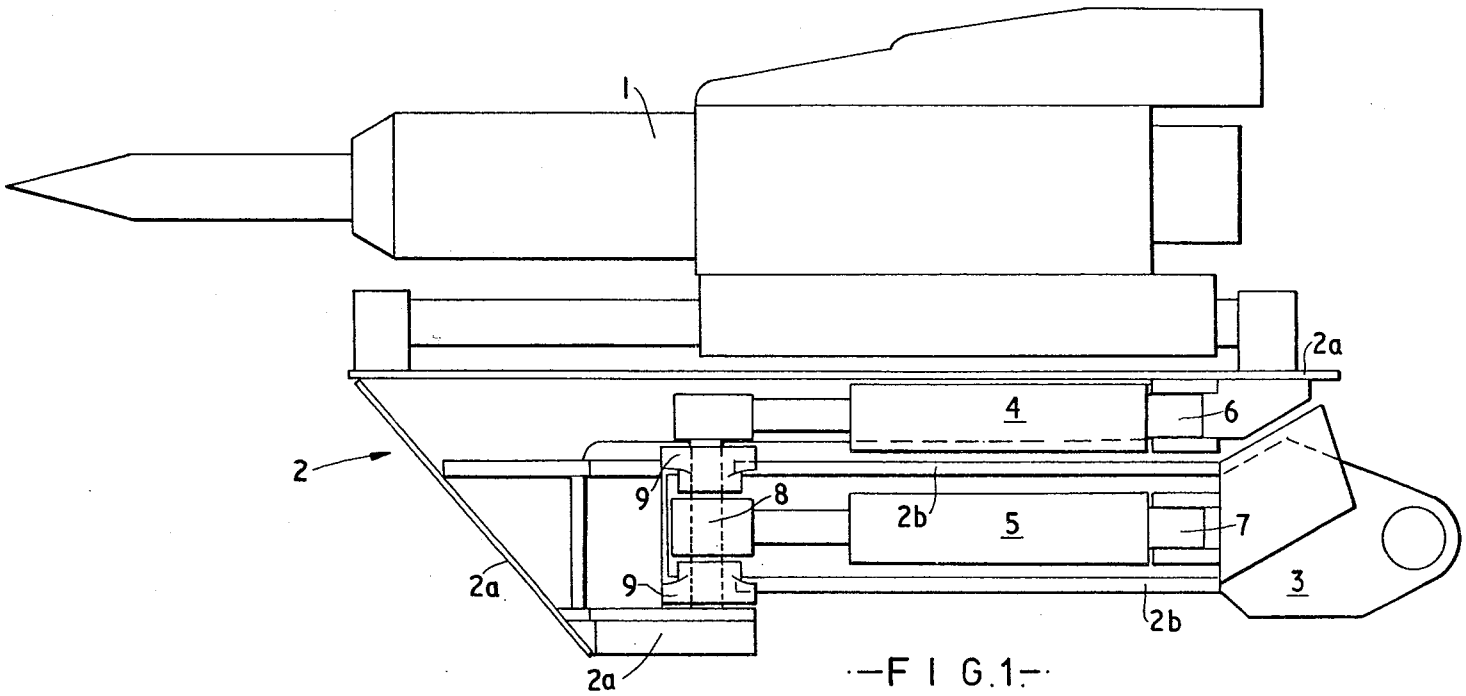
FIG. 1 is a side elevation of an impact chisel and its mounting carriage designed for attachment to the free end of a mounting boom (not shown).
Figure 2:
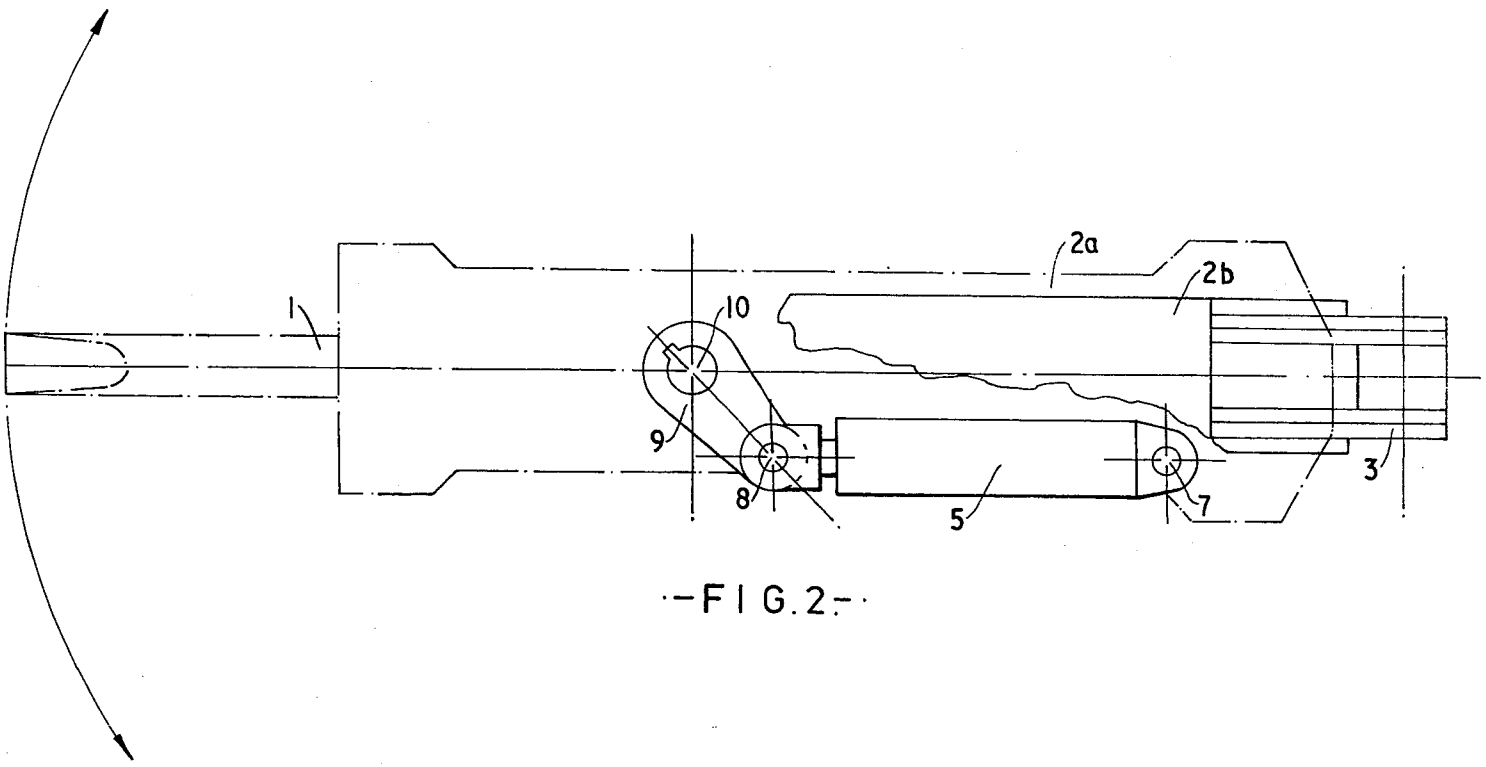
FIGS. 2 and 3 are plan views showing alternative dispositions of the hydraulically controlled link arrangement by which slewing of the tool is effected.

Referring first to FIG. 1, a reciprocating tool indicated schematically at 1 is mounted on a carriage structure 2 which comprises a tool carrier part *2a* pivotally secured to a support part *2b* by means of a vertical pivot pin 10 (see FIG. 2). The carriage structure 2, by means of a coupling bracket 3, can be pivotally attached to the inner member of a telescopic boom (not shown in FIG. 1). Mounted within the frame structure of the two part carriage 2 are two hydraulic rams 4 and 5 the cylinders of which are respectively pivotally attached at 6 to part *2a* and 7 to part *2b*. Both the pistons of the rams 4 and 5 are pivotally attached at their outer ends to a pivot pin 8 extending between upper and lower parts of a link member 9 which at its opposite end is pivotally attached to the pivot pin 10 (FIG. 2) by means of which the parts *2a* and *2b* of the carriage 2 are pivotally connected. The axis of pin 10 is offset with respect to the point of attachment 6 of the cylinder of the ram 4 to such carriage, both longitudinally and transversely.

Figure 3:
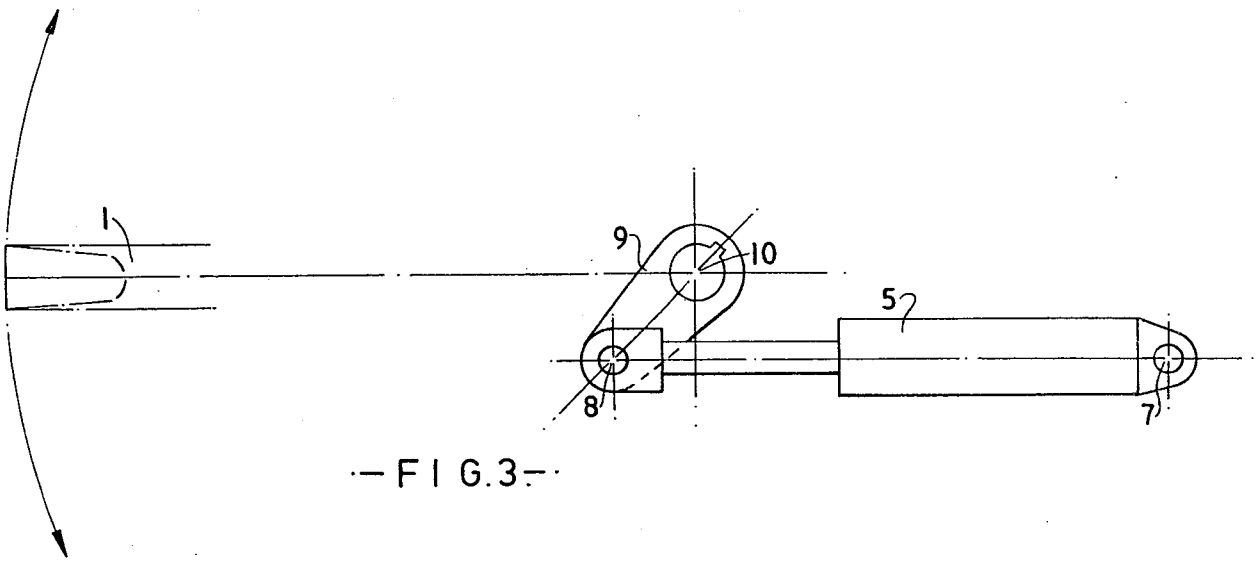

Referring now particularly to FIGS. 2 and 3, pivot pin 8 of the link 9 may be disposed rearwardly of the vertical transverse plane through pivot 10, as shown in FIG. 2, or forwardly of such plane, as shown in FIG. 3, when the longitudinal axis of the carriage part *2a* is lying parallel to that of the carriage part *2b*. In the first case (FIG. 2) the pistons of rams 4 and 5 are in retracted state and in the second case the pistons are extended in both cases maintaining the tool 1 in a central position. Taking the case of FIG. 2 first, if ram 4 is now extended and ram 5 remains in its retracted state, the upper carriage part *2a* and hence the tool 1 is slewed about pivot 10 in a counterclockwise direction (viewed from above) to the position shown in FIG. 4 in order to increase the spacing between point 6 and pivot 8. If, on the other hand ram 5 is extended while ram 4 remains retracted, the carriage part *2a*, and hence the tool 1, is slewed about pivot 10 in the clockwise direction, in order to maintain the same spacing between point 6 and pivot 8, which pivot is displaced from the position shown in FIG. 2 to that shown in FIG. 5.

The disposition of pin 8 and link 9 may be changed, without affecting that of the carriage *2a*, from the first to the second case by the joint operation of both rams 4 and 5.

Figure 4:
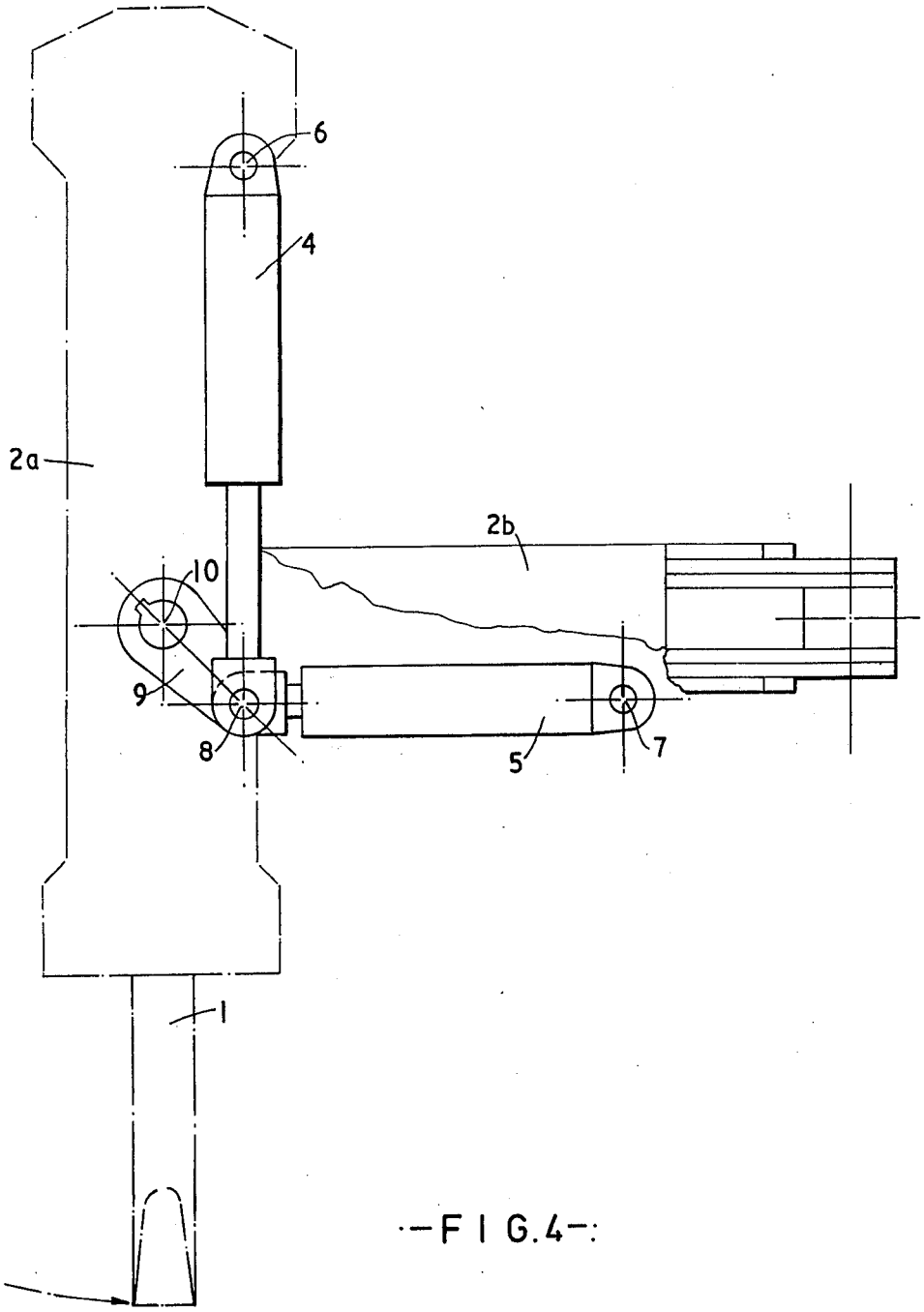
FIGS. 4 and 5 are plan views showing the disposition of the hydraulic rams of the link arrangement of FIGS. 2 and 3 in opposite orientations of the tool.
Figure 5:
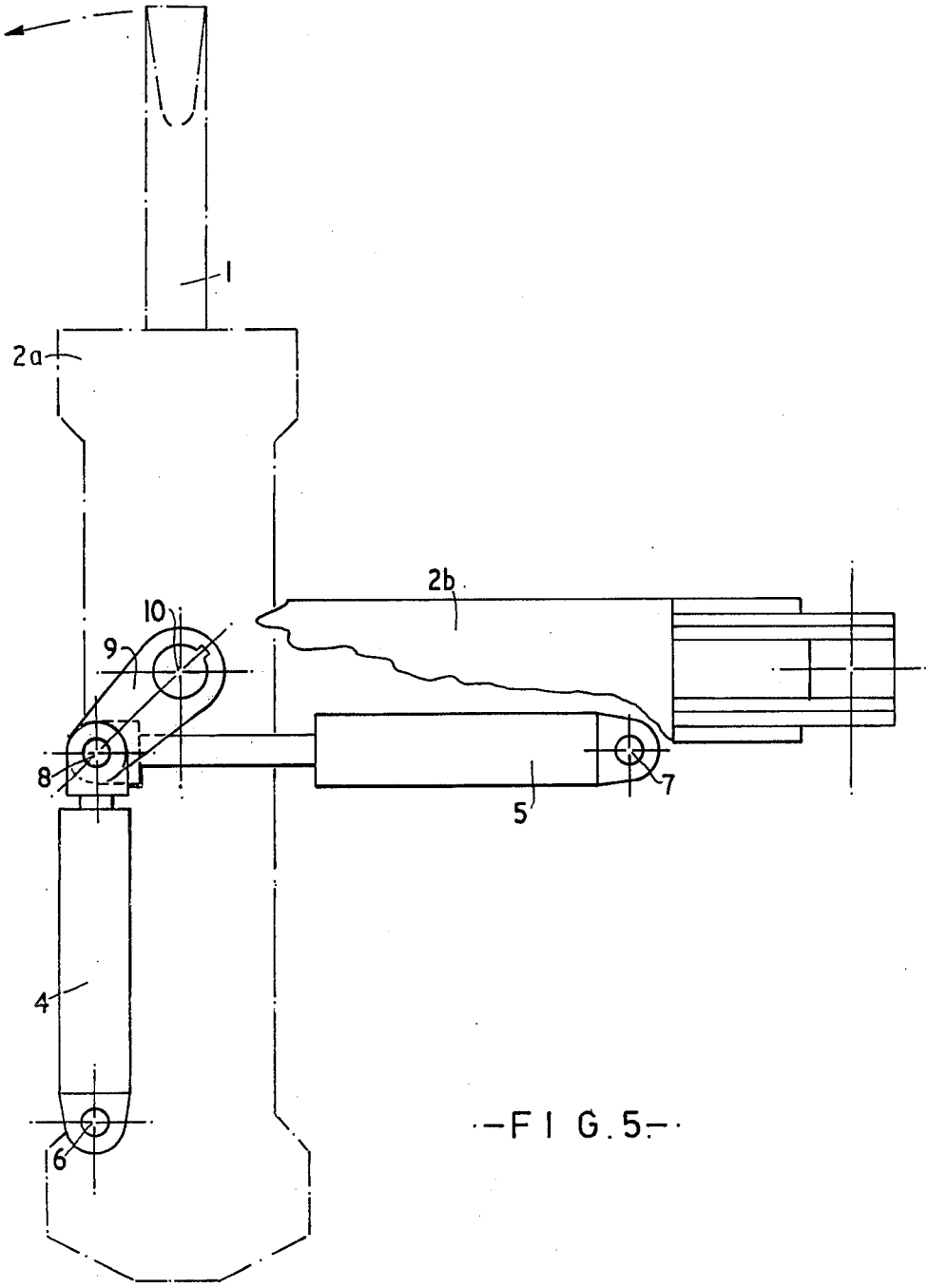

Taking the case of FIG. 3 i.e. with both rams extended, the clockwise slewing effect of the tool 1 to the position shown in FIG. 5 will then be achieved by retracting ram 4 while maintaining ram 5 extended and the counter-clockwise slewing of tool 1 to the position shown in FIG. 4 by retracting ram 5 while maintaining ram 4 extended. The slewed positions of the tool 1 and the corresponding dispositions of the rams 4 and 5 are shown in FIGS. 4 and 5 from which it will be seen that, in the case of FIG. 4 the carriage part *2a* is at right angles to the carriage part *2b* and the rams 4 and 5 are at right angles to each other. To restore the carriage *2a* to the central position shown in FIG. 2, the ram 4 has to be retracted, and to restore the carriage *2a* to the central position shown in FIG. 3, ram 5 has to be extended.

FIG. 5 shows the tool 1 slewed in the opposite direction to that shown in FIG. 4 and from this position the tool 1 may be restored to the FIG. 2 position by retracting ram 5 or to the FIG. 3 position by extending ram 4.

It will be appreciated that from the central position of the tool 1 and carriage part *2a* shown in FIGS. 2 and 3 each of the rams 4 and 5 contributes one half of the total slewing arc. In the foregoing description only those slewing movements, attainable by using one ram to effect movement whilst the other is held in its extended or retracted state, have been referred to. It will be appreciated however that both rams may be operated simultaneously or in sequence to provide a variety of slewing movements and in particular slewing over an arc greater than 90° from the central position shown in FIGS. 2 and 3 can be attained. For example, the angular position of pin 8 with respect to pin 10 can be changed by one of the rams whilst the other ram is functioning to displace carriage part *2a* with respect to carriage part *2b*, or such angular position may be changed when such other ram has slewed part *2a* as far as possible so that further slewing is then possible from the new position of pin 8. The limitations of the total arc of slewing attainable by such conjoint operations of the rams 4 and 5 are those of interference between the rams and the carriage part *2b* and the working strokes of the rams. Slewing through arcs of 180° to either side of the central positions shown in FIGS. 2 and 3 is readily possible by these methods.

Figure 6:
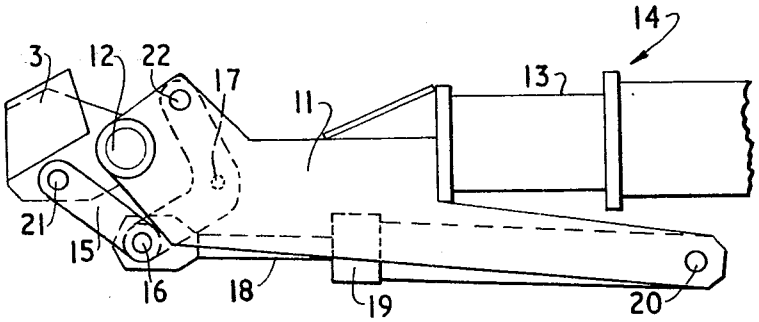
FIG. 6 is a side elevation of a hydraulically controlled linkage between the carriage of FIG. 1 and an extensible boom mounted on the support base (not shown) of the machine.

The arrangements so far described concern slewing of the tool 1 in a horizontal plane but, for full articulation of the tool, it is necessary that it should also be pivotable in a vertical plane. The arrangements for achieving vertical pivoting are shown in FIG. 6, wherein only the bracket 3 of the arrangements of FIG. 1 is shown for simplicity of illustration. This bracket 3 serves to attach the carriage 2 of FIG. 1 to a support bracket 11, of which one side plate is shown in FIG. 6, by means of a pivot pin 12, and the bracket 11 is itself secured to the inner member 13 of a retractable and extensible boom indicated generally at 14 and not shown in detail. The bracket 3 is also linked to the bracket 11 by a linkage consisting of a spaced pair of straight outer links 15 pivotally connected by a pivot pin 16 to an inner curved or L-shaped link 17. The piston 18 of a ram 19 is pivotally connected at its outer end to the pin 16 and the cylinder of ram 19 is pivotally attached at 20 to the bracket 11. The straight outer links 15 are pivotally attached to the bracket 3 at 21 and the curved link 17 is pivotally attached at 22 to the bracket 11. The curvature, or L-shape, of the link 17 is such as to allow this link to pivot about point 22 without jamming on the pivot pin 12.

In the state of the arrangement shown in FIG. 6 the carriage 2 attached to bracket 3 would be extending horizontally. If now, the ram 19 is operated to retract its piston 18 the bracket 3 is pivoted downwardly about pin 12 and if, instead, the ram is operated to further extend its piston, the bracket 3 is pivoted upwardly about pin 12. The angle through which such vertical pivoting movement of bracket 3 and thus carriage 2 and tool 1 can be effected will depend upon the stroke of piston 18 in relation to the distance between point 21 and pin 12 and can be arranged to be such as to provide a full180° of vertical pivoting.

I claim:

1. A mounting arrangment for a mineral displacing tool comprising a carrier for the tool, pivot means pivotably securing said carrier to a support, a link member attached at one end to said pivot means, and first and second pressure-fluid-operated rams pivotally connected to act between the other end of said link means and said carrier and support, respectively, with each ram acting to extend the arc of slewing of the carrier with respect to the support attainable by means of the other ram and about the same pivot axis of said pivot means.

2. A mounting arrangement as claimed in claim 1, wherein one of said rams is arranged to slew said carrier in a clockwise direction from a given position, and the other of said rams is arranged to slew said carrier in a counter-clockwise direction from said given position.

3. A mounting arrangement as claimed in claim 2, wherein each said ram is arranged to slew said carrier through an arc greater than 90°.

4. A mounting arrangement as claimed in claim 2, wherein said rams are arranged to slew said carrier through an arc of 180° to either side of a given position.

5. A mounting arrangement as claimed in claim 1, wherein the ram connected to act between said link and said support is arranged to pivot said link through an angle of at least 90°.

6. A mounting arrangement as claimed in claim 1, wherein said support is attached to a boom in a manner permitting pivotal movement, in a vertical plane, of said support with respect to said boom.

7. A mounting arrangement as claimed in claim 6, wherein the pivotal attachment between said support and boom is such as to permit vertical pivoting of the support through 180°.

8. A mounting arrangement as claimed in claim 6, wherein said boom is a retractable and extensible boom.

9. A mounting arrangement as claimed in claim 6, wherein said support is coupled to said boom by means of a horizontally disposed pivot pin extending between the two side legs of a bifurcated bracket attached to one end of said boom.

10. A mounting arrangement as claimed in claim 9, wherein said support is further coupled to said bracket by a linkage arranged to be varied in effective length by a pressure-fluid-operated ram.

11. A mounting arrangement as claimed in claim 10, wherein the ram for varying the length of said linkage is pivotally attached at one end to said bracket and at its opposite end to a pivot pin to which are also pivotally attached a first link pivotally connected to said support and a second link pivotally connected to said bracket.

12. A mounting arrangement as claimed in claim 11, wherein said second link extends between the side legs of said bracket and is curved in the direction of its length to provide additional clearance from the horizontal pivot pin than would be available if the link was a straight link.

13. A mounting arrangement comprising:

a. tool-carrying means,
b. support means,
c. first pivot means connecting the tool-carrying means with and securing it to the support means,
d. a first pressure-fluid-operated ram having two ends,
e. a second pivot means remote from the first pivot means and connecting the tool-carrying means with and securing it to one end of the first pressure-fluid-operated ram,
f. a second pressure-fluid-operated ram having two ends,
g. a third pivot means remote from the first pivot means and connecting the support means with and securing it to one end of the second pressure-fluid-operated ram,
h. link means having two ends, each of which is adapted to pivot on pivot means and one end of which is pivotally connected to the first pivot means, and
i. a fourth pivot means pivotally connected with the other end of the link means and also the other end of each of the first and second pressure-fluid-operated rams.

* * * * *